US006313733B1

(12) United States Patent
Kyte

(10) Patent No.: US 6,313,733 B1
(45) Date of Patent: Nov. 6, 2001

(54) CHILD PAGER SYSTEM

(76) Inventor: Ricky R. Kyte, 1345 Camden Ct., Mobile, AL (US) 36695

( * ) Notice: Subject to any disclaimer, the term of this patent is extended or adjusted under 35 U.S.C. 154(b) by 0 days.

(21) Appl. No.: 09/012,278

(22) Filed: Jan. 23, 1998

(51) Int. Cl.[7] ..... G04B 23/00
(52) U.S. Cl. ..... 340/7.22; 340/573.1; 340/573.4
(58) Field of Search ..... 340/825.45, 825.49, 340/815.56, 311.1, 982, 539, 815.65, 573.1, 573.4, 573.3, 7.22; 379/68; 455/134

(56) References Cited

U.S. PATENT DOCUMENTS

| | | | | |
|---|---|---|---|---|
| 4,197,497 | | 4/1980 | Phelps | 455/18 |
| 4,593,273 | | 6/1986 | Narcisse | 340/539 |
| 4,675,656 | | 6/1987 | Narcisse | 340/539 |
| 4,777,478 | * | 10/1988 | Hirsch et al. | 340/573 |
| 4,899,135 | * | 2/1990 | Ghahariiran | 340/573 |
| 4,924,211 | | 5/1990 | Davies | 340/573 |
| 4,998,095 | | 3/1991 | Shields | 340/574 |
| 5,224,150 | * | 6/1993 | Neustein | 379/57 |
| 5,245,314 | | 9/1993 | Kah, Jr. | 340/539 |
| 5,247,293 | | 9/1993 | Nakagawa | 340/825.25 |
| 5,289,163 | * | 2/1994 | Perez et al. | 340/539 |
| 5,461,365 | * | 10/1995 | Schlager et al. | 340/573 |
| 5,557,259 | | 9/1996 | Musa | 340/573 |
| 5,557,300 | * | 9/1996 | Satoh | 345/170 |
| 5,587,704 | | 12/1996 | Foster . | |
| 5,598,143 | | 1/1997 | Wentz | 340/539 |
| 5,617,074 | | 4/1997 | White | 340/573 |
| 5,629,678 | | 5/1997 | Gargano et al. . | |
| 5,640,147 | * | 6/1997 | Chek et al. | 340/573 |
| 5,650,770 | * | 7/1997 | Schlager et al. | 340/573 |
| 5,805,981 | * | 9/1998 | Sugio et al. | 455/38.4 |
| 6,114,950 | * | 9/2000 | Schaible et al. | 340/435 |

* cited by examiner

*Primary Examiner*—Hassan Kizou
*Assistant Examiner*—Duc Ho
(74) *Attorney, Agent, or Firm*—Kenneth L. Tolar

(57) ABSTRACT

The present invention relates to a child pager system including a transmitter unit which may transmit one of a plurality of messages to a select one of a plurality of pager units. The transmitter unit has a plurality of channel selection switches each predesignated for a particular pager. The transmitter unit also has a plurality of transmission buttons each in communication with a separate light means on a pager unit whereby each transmission button transmits a signal indicating a different level of urgency to the pager carrier. Each pager unit has a panic means in communication with an internal transmission means that is automatically activated when the pager unit is removed from a carrier's belt. A panic signal is then transmitted to the transmitter unit and a light means on the transmitter unit is illuminated indicating which pager unit sent the signal. The panic means also activates a sound recording means on the pager unit whereby the carrier can quickly record a message in the event of an assault or another sudden emergency. The transmitter unit also has a plurality of lights each varying in color for indicating the relative distance of a pager unit in communication therewith.

5 Claims, 3 Drawing Sheets

CHILD PAGER SYSTEM

BACKGROUND OF THE INVENTION

The present invention relates to a child pager system in which a transmitter can selectively communicate with any one of a number of receiver units, can determine the relative distance of each receiver unit and can receive a distress signal therefrom. Each receiver unit has an automatic panic means which when activated transmits a distress signal back to the transmitter which can then attribute the signal to a particular pager.

DESCRIPTION OF THE PRIOR ART

In certain situations, it is almost impossible for parents to continuously monitor their children as is often the case in shopping malls, amusement parks, restaurants and other public places where children typically wander or stray. Whenever a child becomes lost or is accosted, it is typically difficult for the child to communicate with his or her parents. If a child is old enough to operate a telephone and a telephone is accessible, the parents may not be near a phone to receive a call. In most cases, however, a phone will not be accessible, or, in the case of an emergency, such as a kidnaping or an assault, the child will simply not be able to call. Additionally, parents often need a convenient method to transmit a message directly to a child in non-emergency situations such as notifying the child to return home or to a predesignated meeting place.

Many devices have previously been developed which are designed to transmit messages or signals from a remote location to a receiving device such as a pager. For example, U.S. Pat. No. 5,247,293 issued to Nakagawa relates to a wireless device allowing a user to remotely control and listen to a cassette player in communication therewith.

U.S. Pat. No. 4,998,095 issued to Shields relates to an emergency transmitter system comprising a plurality of fixed transceivers located at various locations within a predetermined geographic area which communicate with various portable transmitters issued to selected individuals.

U.S. Pat. No. 4,924,211 issued to Davies relates to a personal monitoring system designed for people under house arrest comprising a plurality of local units for transmitting signals to a corresponding mobile unit.

U.S. Pat. No. 5,640,147 issued to Chek et al relates to a child monitoring system comprising a device attachable to a child's clothing having a sensitive audio microphone thereon in communication with a receiver unit allowing the holder of the receiver unit to periodically listen to activity proximal the child unit.

U.S. Pat. No. 5,557,259 issued to Musa relates to a proximity alert and direction transmitter mounted on a person's shoe which communicates with a receiver bracelet. The receiver has a proximity detector with a threshold set that emits an audible sound when the distance between the subject and the observer exceeds a preset distance.

U.S. Pat. No. 5,245,314 issued to Kah, Jr. relates to a location and monitoring system comprising a radio frequency transmitter and receiver in which the receiver sounds an alarm at a predetermined time after failure to receive a transmitter signal. The device is capable of scanning for several transmitter signals so that one person with the receiver can monitor the location of several children.

Although child monitoring devices exist in the prior art, these devices do not have the features and advantages of the present invention such as a receiver unit having an automatic panic means which activates a sound recording chip and transmits a panic signal to the transmitter. The transmitter further comprises a plurality of message transmission means each corresponding to a different level of urgency with which a person receiving the message should respond. Furthermore, the present invention has a unique tracking mechanism which allows a holder of the transmitter unit to selectively determine the relative distance between it and a select one of a plurality of receiver units in communication therewith.

SUMMARY OF THE INVENTION

The present invention relates to a child pager system comprising a transmitter unit having radio frequency transmission and receiver circuitry therein. On the exterior surface of the transmitter unit are a plurality of channel selection buttons each corresponding to a discrete square wave frequency signal to be transmitted via an externally mounted, telescoping antenna. Each discrete frequency transmission signal will communicate with a separate child pager/receiver device which is attachable to a child's clothing or belt. Accordingly, the transmitter can selectively transmit messages to or receive messages from any one of a plurality of different receivers allowing a user to selectively monitor one or more children.

Adjacent each channel selection button is a channel signal light for indicating which pager device is transmitting a panic signal as described below. Horizontally disposed along the exterior of the transmitter unit are a plurality of aligned signal strength indicator lights each in selective communication with the channel selection switches and the corresponding pager units. The strength indicator lights are arranged sequentially from varying shades of green, amber to red each corresponding to a different relative distance of the pager unit transmitting or receiving a signal. Accordingly, a user may press one of the channel selection buttons at which time the signal strength indicator lights indicate the relative distance of the corresponding receiver/pager unit. Progressing from green to red, each succeeding light would correspond to a greater relative distance between the transmitter and the corresponding pager. Accordingly, a person holding the transmitter may "track" the person holding a pager unit by periodically pressing the corresponding channel selection button as the user travels from one location to another.

The pager/receiver unit resembles a standard pager device having a substantially rectangular housing within which is a transmitter and receiver means similar to that of the transmitter unit. On a side of the housing are a plurality of light means for indicating that a message has been transmitted from the transmitter unit. Each light means corresponds to a different level of urgency with which the person receiving the signal should respond thereto.

The pager unit has a pivotally engaging belt clip for easily securing the device to a user's belt. The belt clip normally engages a pressure sensitive panic button in communication with an external microphone and a recording sound chip. When the device is attached to a user's belt, the clip is disengaged from the panic button. Accordingly, if a child is in distress, he or she may remove the receiver causing the belt clip to engage the panic button, automatically activating the recorder allowing the child to record a message. At the end of the predetermined recording duration, a speaker on a side of the housing would emit a piercing sound emission to alert people in the immediate area or to frighten an attacker. A play button is provided on a side of the receiver unit allowing the recorded message to be replayed. The panic button is also in radio communication with a panic light on the transmitter unit such that when the panic button is activated, the panic light on the transmitter is illuminated. When the panic button on a particular pager is activated, a channel signal light corresponding to the pager is likewise illuminated thereby visually indicating which pager's panic button has been activated. An audible alarm is also emitted through a speaker on the transmitter unit.

It is therefore an object of the present invention to provide a child pager system which may selectively communicate with any one of a plurality of receiver units.

It is yet another object of the present invention to provide a child pager system in which the receiver/pager units have an automated sound recording means thereon.

It is yet another object of the present invention to provide a child pager system having a transmitter device which can selectively determine the relative distance of any one of a number of corresponding pager devices in communication therewith.

It is yet another object of the present invention to provide a child pager system which may transmit to a select pager one of a plurality of messages each corresponding to a different level of urgency.

It is yet another object of the present invention to provide a child pager system in which each pager unit has a panic means which automatically emits a loud piercing noise and which transmits a signal to the transmitter unit allowing the holder thereof to attribute the signal to a particular pager. Other objects, features and advantages of the present invention will become readily apparent from the following detailed description of the preferred embodiment when considered with the attached drawings and the appended claims.

DESCRIPTION OF THE PREFERRED EMBODIMENT

Figures 1, 2, 3:
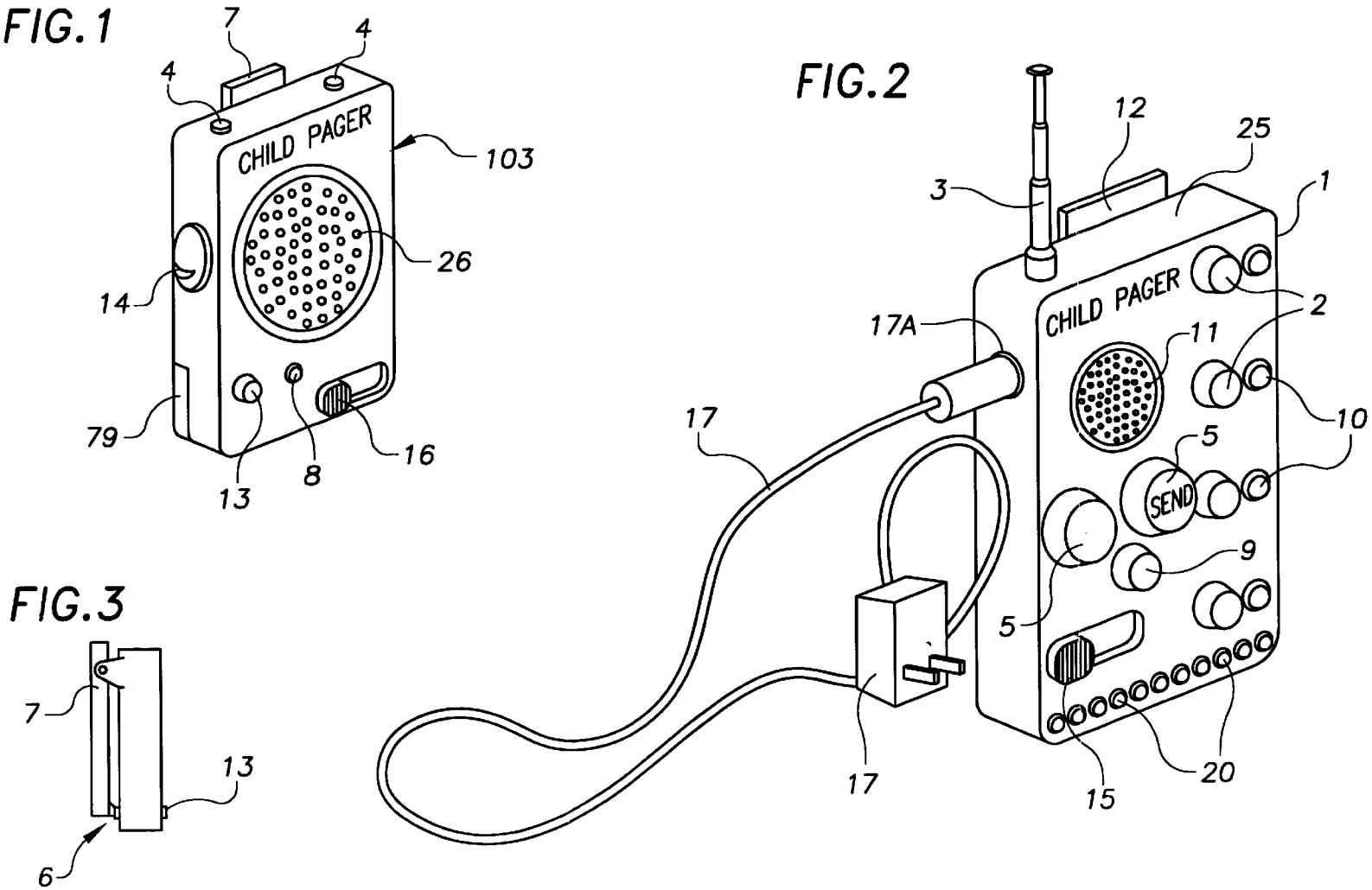
FIG. 1 depicts the pager/receiver unit according to the present invention.
FIG. 2 depicts the transmitter unit.
FIG. 3 depicts a side view of a pager unit.

Referring now to FIGS. 1 through 4, the present invention relates to a child pager system including a transmitter unit 25 comprising a substantially rectangular hollow base component 1 having a front surface, a back surface and four peripheral edges therebetween. Extending from the top surface of the base component is a telescopic antenna 3 for assisting in the transmission and reception of a radio frequency signal. On the front surface of the base component are a plurality of channel selection buttons 2 in communication with a radio frequency transmitter system (not pictured) received within the base component, the circuitry of which is depicted in FIG. 3 and is described in more detail below. Each channel selection button 2 corresponds to a discrete predetermined square wave frequency to be transmitted for selectively communicating with any one of a plurality of pager units.

Adjacent each channel selection button 2 is a light 10 for identifying which pager unit has transmitted a panic situation as described below. Also on the front surface of the base component 1 are two or more transmission switches 5 each for emitting a separate, discrete transmission signal which will illuminate a separate light means 4 on a pager unit as described below. The transmitter unit has a speaker 11 disposed on its exterior for emitting an audible alarm upon receiving a panic signal from a pager unit. The transmitter may also have a belt clip 12 for attaching it to a user's belt.

The system also comprises a plurality of pager/receiver units 3 each selectively receiving a signal from the transmitter unit depending upon which channel selection button has been activated. Each pager unit 3 also has a transmitter circuit therein for transmitting a panic message to the transmitter unit. Accordingly, by depressing one of the channel selection buttons 2, the user may selectively communicate with a select one of a number of separate receiver/pagers.

Each receiver unit 3 comprises a substantially rectangular hollow housing having front and back surfaces and four peripheral edges therebetween. On a peripheral edge are a plurality of light means 4 each in communication with a separate transmission switch 5. Preferably each light means 4 emits a unique color when activated by a transmission switch 5, each corresponding to a preselected degree of urgency with which the signaled person should respond (i.e. return immediately, call home etc.). Two light means 4, two transmission switches 5 and four channel selection buttons 2 are depicted in FIG. 1. However, as will be readily apparent to those skilled in the art, any number of light means, switches and buttons may be provided without departing from the spirit of the present invention. Accordingly, selected degrees of urgency with which a child should respond to the signal are provided by pressing a channel selection switch corresponding to a particular pager, then, depressing one of the transmission switches 5 corresponding to the desired urgency. For example, a red light on a pager unit in communication with a first transmission 5 switch may be provided to transmit an urgent situation and an amber light in communication with a second transmission switch can transmit a non-emergency situation.

Disposed on the back surface of the pager unit is a pivotally engaging belt clip 7 for easily attaching the device to a user's belt, pants or other clothing items. The belt clip 7 is biased towards and normally engages a pressure sensitive panic button 6 disposed on the back surface of the pager unit. The panic button is in communication with a sound recording chip and a sound producing circuit 48. A condenser microphone 8 in electrical communication with the recording chip is disposed on the front surface of the pager for receiving and recording audible messages thereon. Accordingly, in an emergency situation such as if the child is being kidnaped or assaulted, the child or other person carrying the device may remove it from his or her belt. The belt is then no longer disposed between the panic button and the clip allowing the belt clip 7 to engage the panic button 6 at which time the child may record a brief message. The panic button 6 will also automatically activate an alarm means capable of emitting an ear piercing, high decibel tone via a speaker 26 to alert people in the vicinity that the child is in distress. The panic button 6 is also in radio frequency communication with a panic light 9 disposed on the front surface of the transmitter unit alerting the person monitoring the child that an emergency is occurring. Furthermore, each pager panic button 6 is in wireless communication with the light 10 adjacent its corresponding channel selection switch allowing a person holding the transmitter unit to attribute the panic signal to a particular pager.

On a side of each receiver unit is a message indicator light 13 for visually indicating when a message has been recorded. A play button 14 is likewise disposed on the exterior surface of a receiver unit and is in communication with the sound recording chip allowing the message recorded during the panic mode to be replayed.

Both the transmitter and receiver units are selectively activated using a power switch 15,16 respectively, and each are powered with a battery means 78,79 which may be recharged with an accompanying adaptor 17. The adapter may be connected to an external jack 17A.

Horizontally disposed on the front surface of the transmitter unit are a plurality of signal strength indicator lights 20 sequentially disposed according to color from dark green to dark red with amber lights therebetween. The lights 20 are in communication with each pager and the channel selection switches. By depressing a channel selection switch, a user may determine the relative distance of a particular pager in communication therewith by viewing the indicator lights. For example, the green indicator lights would indicate that the particular pager unit is within a predetermined distance of the base component. Amber indicator lights would indicate that the pager is at a farther distance and the red indicator lights would indicate that the particular pager is even a greater distance from the transmitter unit. Therefore, a user may quickly and easily determine the relative distance of each person carrying a pager device. The user may travel in various directions periodically pressing the channel selection switch until a green light is illuminated allowing the user to pursue a select pager.

Figure 4:
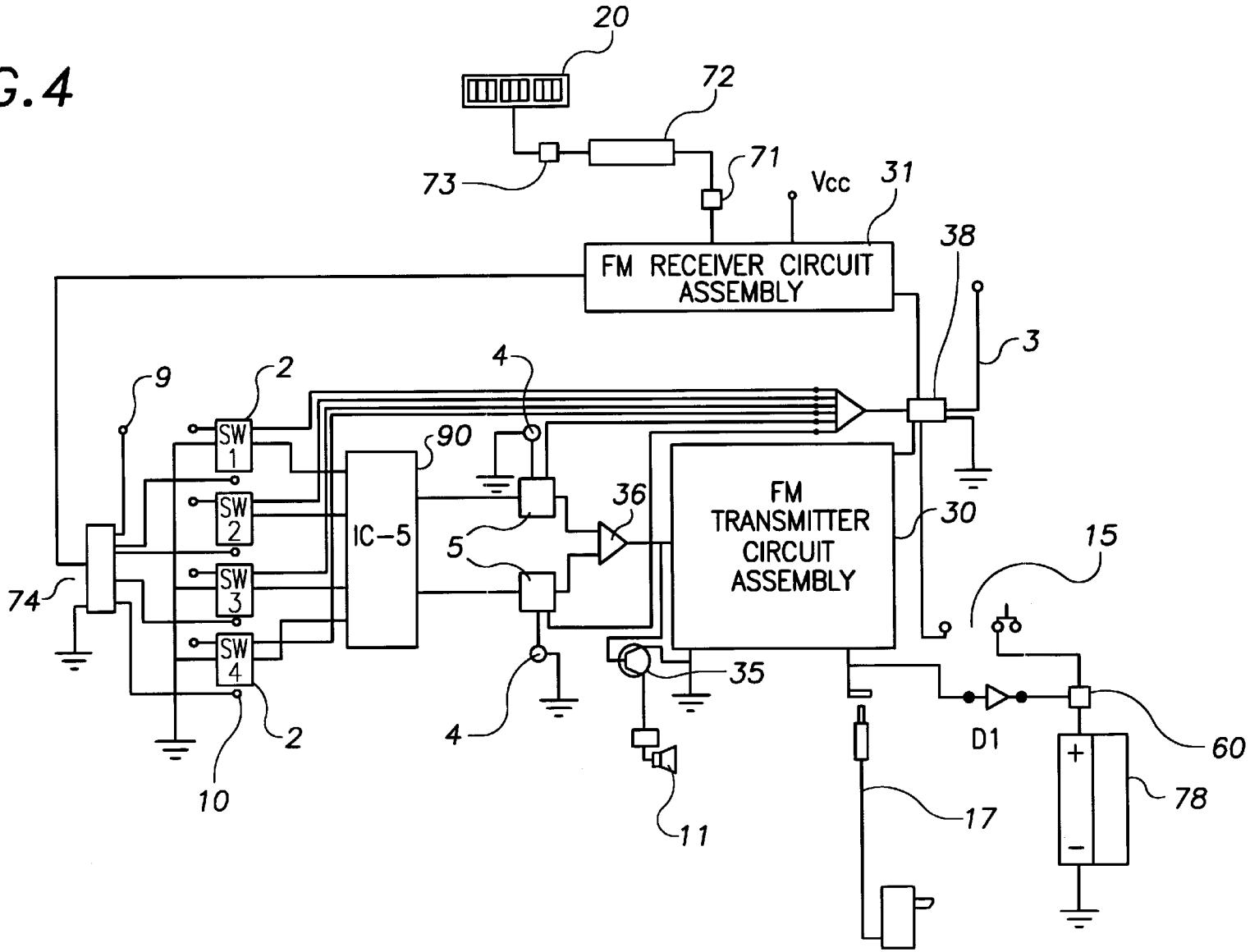
FIG. 4 depicts a schematic of the transmitter unit circuitry.

Referring now to FIG. 4, the circuitry associated with the transmitter unit is depicted. The transmitter unit includes an FM transmitter circuit 30 and an FM receiver circuit 31. The receiver circuit 31 receives a signal from a transmitter located within a pager unit described in more detail below. The circuits are powered by the rechargeable battery means 78 described above and the voltage is regulated by integrated circuit 60.

The relative strength of a signal received from a pager transmitter is amplified by an associated audio amplifier circuit 71 in communication with an L.E.D. level meter circuit 72 and a bargraph circuit 73. The bargraph circuit 73 determines the relative strength of the signal received from a particular pager.

Each transmitter within each pager transmits on the same FM frequency but each has its own distinguishing square wave tone frequency. When a signal is received by the receiver circuit 31 such as when the panic mode 15 is activated, the tone is decoded with a phase locked loop tone decoder 74 which illuminates the panic mode LED on the transmitter unit. The tone decoder 74 also determines which child pager transmitter sent the signal and illuminates the light means adjacent the appropriate channel selection button.

The transmitter circuitry 30 is capable of transmitting a digital notification signal to any one of the pager receiver units by means of a same tone transmitting technique. When a particular channel switch is selected, a tone generator circuit 90 produces any one of a plurality of separate square wave frequency tones which communicate with a tone decoder circuit 41 within the pager (see below). When a channel switch is activated, a discrete frequency is transmitted. The frequency transmitted by transmission switches 5 for a given urgency level remains constant regardless of the channel selected. Since selecting a channel will only activate that particular pager's tone decoder circuit, the appropriate light means will be illuminated only on the pager selected. When a panic button is activated, a tone signal is fed to transmitter via buffer 36 and triggers transistor 35 activating the audio oscillator/amplifier/speaker 36 creating an audible alarm.

The transmitter unit antenna is normally set by relay 38 to receive signals and feed the signals to the FM receiver. By actuating a channel selector switch, tone generator circuit 90 delivers a voltage to relay 38 thereby closing relay 38 allowing a signal to be transmitted through the antenna. In absence of such a signal, the relay 38 causes the antenna to return to the receive mode.

Figure 5:
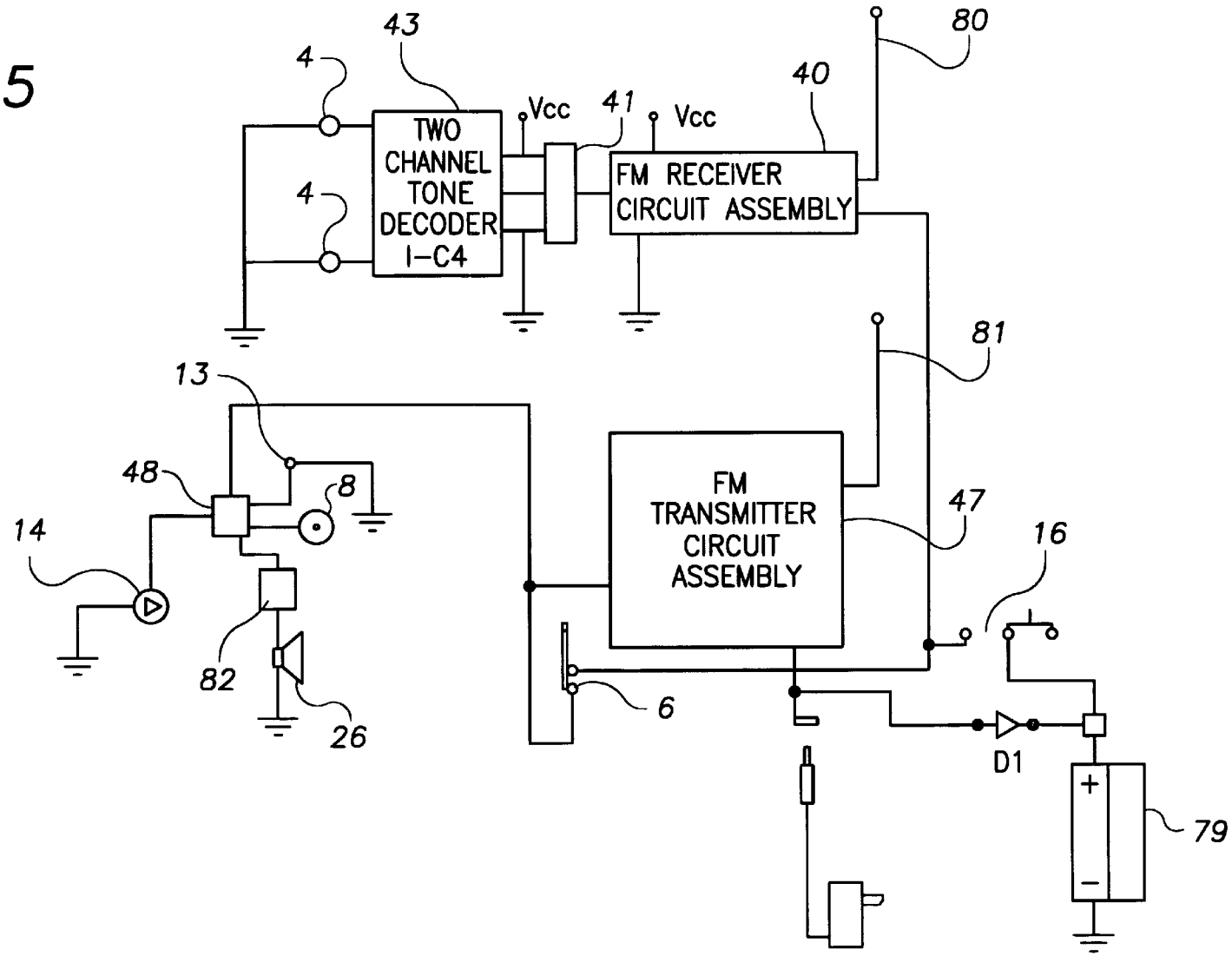
FIG. 5 depicts a schematic of the pager/receiver unit circuitry.

The pager circuitry is depicted in FIG. 5. As with the transmitter unit, the pager units each comprise an FM transmitter and an FM receiver circuit. The receiver circuit 40 receives a digital square wave tone from the transmitter unit which is connected to a phase locked loop (PLL) tone decoder integrated circuit 41. If the received digital square wave riding on the FM carrier wave matches the frequency set on the phase locked loop tone decoder, the signal is transmitted to a two channel PLL decoder integrated circuit 43 which responds to the second signal riding on the FM carrier wave. A first tone activates the amber LED indicating a routine response and the other activates the red LED indicating an emergency response.

When the panic button is activated, switch 46 activates the transmitter 47 which has an on-board digital square wave generator set for a specific frequency. A signal is transmitted to the transmitter unit in which its PLL decoder 74 will respond to the particular frequency tone being generated by illuminating the appropriate indicator light adjacent the corresponding channel selection button. As opposed to the transmitter unit, separate internal wave antennas 80,81 are used for the pager transmitter and receiver circuits.

A solid state audio storage integrated circuit 48 is activated by the emergency belt clip switch 46 and stores a voice message of a predetermined duration. The condenser microphone 8 is connected to integrated circuit 48 as is the stored message LED 13. The output of the audio storage chip is connected to an audio amplifier integrated circuit 82 and a speaker 83 for selectively playing the audio message.

To use the above described device, each child to be monitored would be assigned a pager unit. The child would then clip the device to his or her belt thereby de-activating the panic switch and the power switch would be placed to the "on" position. A person operating the transmitter unit may activate a channel selection switch corresponding to the pager to be signaled then activate one of the transmission buttons to deliver a message requesting a predetermined response. To determine the relative distance of a particular pager device, a person monitoring the transmitter unit may again activate the appropriate channel selection switch. The signal strength indicator lights would illuminate indicating the relative distance of the particular paging device. In an emergency situation, the child can remove the pager causing the belt clip to engage the panic button thereby activating the recording chip and a loud piercing alarm will be emitted. An audible alarm is emitted on the transmitter unit and the panic mode light and the appropriate channel signal light on the transmitter unit are then illuminated.

Although there has been shown and described the preferred embodiment of the present invention, it will be readily apparent to those skilled in the art that modifications may be made thereto which do not exceed the scope of the appended claims. Therefore, the scope of the invention is only to be limited by the following appended claims.

What is claimed is:

1. A child pager system comprising:

a transmitter unit having means for transmitting and receiving a plurality of discrete wireless signals; said transmitter unit further including means for transmitting a select one of a plurality of messages, each message corresponding to a different level of urgency;

a plurality of pager devices, each pager device having means for receiving a discrete signal from said transmitter unit, each of said pagers also having a transmitter means for selectively transmitting a discrete signal to said transmitter unit;

a distance indication means on said transmitter unit for selectively determining a relative distance of each of said pager devices, said distance indication means including a plurality of lights, each illuminating a different color when activated, said lights in selective wireless communication with each of said pager units, each of said lights, when illuminated, indicating a discrete relative distance of a select unit in communication therewith;

a panic means on each of said pager devices in communication with the pager transmitter means for automatically transmitting a distress signal to said transmitter unit; said panic means in communication with a sound recording means for recording a message when said panic means is activated; said panic means including a pressure sensitive panic button on the exterior surface of said pager unit and a clip on the exterior surface of each of said pager units, said clip biased against said panic button whereby said pager is attached to a user's belt with the belt between the clip and the panic button so that, when the pager unit is removed therefrom, the clip engages the panic button to activate said panic means;

a light means on each of said pager devices for indicating when a message has been recorded on said sound recording means;

a playback means for selectively playing a message that has been recorded on said sound recording means;

a plurality of light means on said transmitter unit each corresponding to a select pager for indicating which pager's panic means has been activated.

2. A child pager system according to claim 1 wherein said means for transmitting a select one of a plurality of messages comprises:

a plurality of transmission means on said transmitter unit each for transmitting a discrete wireless signal to a preselected pager device;

a plurality of light means on each of said pager devices, each light in selective communication with a separate transmission means and each corresponding to a message having a select urgency.

3. A child pager system according to claim 1 wherein said panic means is in communication with the pager's transmission means for activating a panic indication means on said transmitter unit.

4. A child pager system according to claim 1 wherein said panic means is in communication with an alarm means on said pager device for emitting an audible alarm when said panic means is activated.

5. A child pager system according to claim 1 wherein said panic means is in communication with an alarm means on said transmitter unit for emitting an audible alarm when said panic means is activated.

* * * * *